US006363737B1

(12) United States Patent
Raney

(10) Patent No.: US 6,363,737 B1
(45) Date of Patent: Apr. 2, 2002

(54) HEAT EXCHANGER AND METHOD OF USE THEREFOR

(76) Inventor: Robby D. Raney, 6823 N. 200 W., Greenfield, IN (US) 46140

( * ) Notice: Subject to any disclaimer, the term of this patent is extended or adjusted under 35 U.S.C. 154(b) by 0 days.

(21) Appl. No.: 09/520,641

(22) Filed: Mar. 7, 2000

(51) Int. Cl.[7] ..... F25B 13/00

(52) U.S. Cl. ..... 62/324.6; 62/324.1; 62/513; 165/156

(58) Field of Search ..... 62/324.1, 324.6, 62/498, 513; 165/154, 155, 156

(56) References Cited

U.S. PATENT DOCUMENTS 2,611,585 A * 9/1952 Boling
3,698,202 A * 10/1972 Missimer
3,730,229 A * 5/1973 D'Onofrio ..... 165/156
3,872,682 A * 3/1975 Shook
4,015,567 A * 4/1977 Zabenskie
4,562,890 A * 1/1986 Matoba ..... 165/156 X
4,753,285 A 6/1988 Rawlings
4,895,203 A * 1/1990 McLaren ..... 165/156 X
5,245,836 A * 9/1993 Lorentzen et al.
5,477,914 A 12/1995 Rawlings
5,931,224 A 8/1999 Chevallier
5,931,379 A 8/1999 Kim
5,933,574 A 8/1999 Avansino

* cited by examiner

*Primary Examiner*—Henry Bennett
*Assistant Examiner*—Chen-Wen Jiang
(74) *Attorney, Agent, or Firm*—Slaughter & Rosenberg; Marshall E. Rosenberg

(57) ABSTRACT

Apparatus for and method of use for a heat exchanger in an HVAC system having a system refrigerant for heat transfer between a radiator and a heat exchanger, in heat transfer communication through the heat exchanger. Single or multiple heat exchange loops and flow controllers maintain system balance during operation of the system.

16 Claims, 2 Drawing Sheets

HEAT EXCHANGER AND METHOD OF USE THEREFOR

BACKGROUND OF THE INVENTION

1. Field of the Invention

The method and apparatus of the present invention relate to the field of heat exchangers, and more particularly to heating, ventilation and air conditioning systems.

2. Description of the Related Art

There are numerous heating, ventilation and air conditioning protocols in use today, for use in industrial, commercial, automotive, and residential applications. Generally, a heating system heats a selected environment by using the heat which is generated when a fuel is combusted in a burner, for heating a liquid or gaseous fluid, and then circulating the heated fluid through a circulatory system including radiators or outlets installed in the selected environment. Likewise, cooling systems including prior art air conditioning systems and heat pumps utilize a refrigerant to extract a heat component from the refrigerant flow on a continuous flow basis. In all of these systems, bidirectional flow relative to a heat exchanger is required to achieve the desired level of heat exchange necessary to heat/cool the selected environment. Specifically, the heat exchanger of the related art includes a first fluid that flows from one chamber to another chamber through bypass or cross-flow conduits, so as to exchange heat with a second fluid flowing in the passages of adjacent, heat-conductive conduits. Such heat exchangers are used as evaporators in coolant fluid circuits in stationary residential, commercial, industrial and automotive applications. Typically, a refrigerant fluid is the first fluid, the second fluid being atmospheric air. Alternatively, the second fluid is typically available in large quantities at substantially low cost, for use in bulk flow heat exchangers, such as water. As is well known in the art, larger industrial heat exchangers are located near large bodies of water, while smaller installations and mobile applications require either a piped-in or on-board supply of water. In any case, however, the prior art relies on relatively high flow through rates of a coolant, such as water, to provide acceptable levels of heat transfer.

Generally, the prior art utilizes plate-type heat exchangers, wherein each plate of the heat exchanger is provided in the form of a fin or shallow tray, and is formed with two apertures serving as the inlet and outlet, respectively, for the first refrigerant fluid. The chamber which is defined between the two plates of any single pair of plates includes an internal partition which gives the fluid flowing in the chamber a generally U-shaped flow path between the inlet aperture and the outlet aperture. This partition is generally formed by sealingly joining together two longitudinal projecting ribs each of which forms part of a respective one of the plates in that pair of plates. The communicating apertures are typically formed in a projecting element or pocket which is arranged at one end of each plate. In addition, the plates are generally joined together at their other end by a base plate which provides spacing between the pair of plates.

When the heat exchanger serves as an evaporator, the refrigerant fluid enters the heat exchanger in the liquid state and leaves the heat exchanger in the vapor state, after having cooled a stream of air by evaporation. Often, water or water-based solutions are used as the second fluid in the so-described systems. Such use is common to HVAC systems both small and large due to a relatively low water costs, as described above, especially in larger systems with long pipe runs and large fluid capacity and heat transfer requirements. However, a water or water-solution based refrigerant/coolant system does not provide optimized, high efficiency operation due primarily to relatively poor heat exchange properties on a specific mass basis. As a result, the necessary plumbing systems mandate massive space and weight requirements.

Accordingly, there is a need for a system and apparatus for overcoming the shortcomings of the related, prior art HVAC systems.

SUMMARY OF THE INVENTION

The present invention is a method and apparatus of use of a heat exchanger in an HVAC system utilizing a system refrigerant for heat transfer between a radiator and a heat exchanger, for flowing the refrigerant in heat transfer communication through the heat exchanger. Single or multiple heat exchange loops and flow controllers maintain system balance during operation of the system.

DESCRIPTION OF THE PREFERRED EMBODIMENTS

Figure 1:
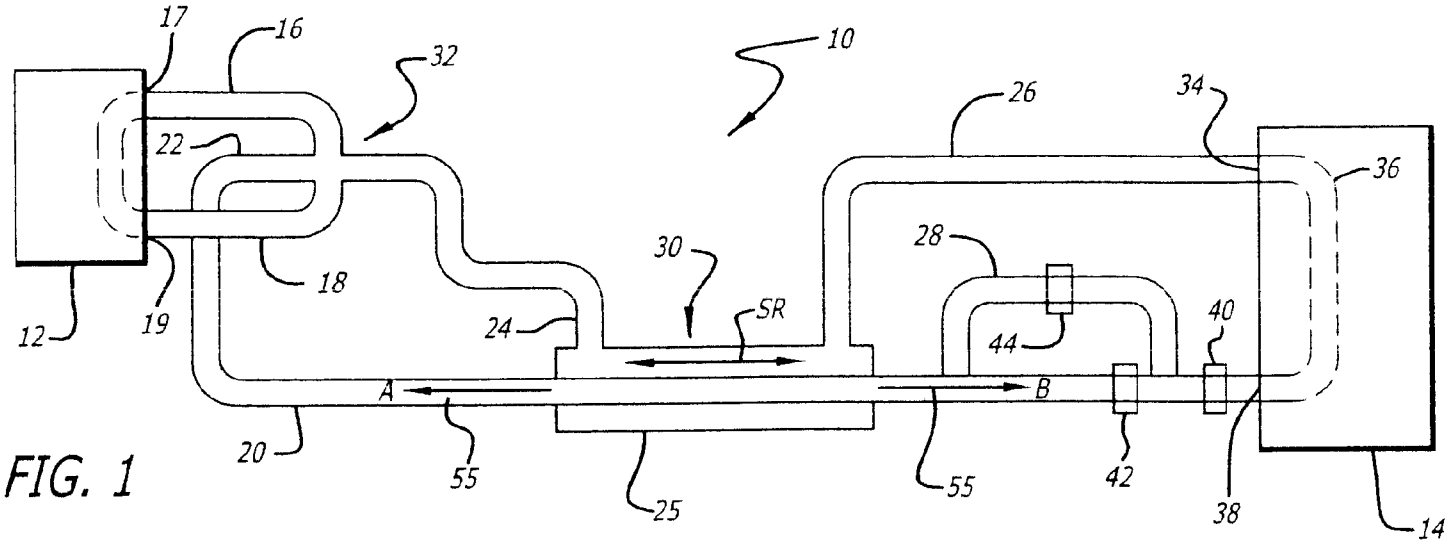
FIG. 1 is a block diagram representation of a first embodiment of the HVAC system of the present invention, showing a single circuit reversing valve system switchable between heating and air-conditioning functions.

With reference now to the drawings, FIG. 1 schematically illustrates one embodiment of the heat exchanger apparatus and system of the present invention. As shown, system 10 includes a compressor 12 in fluidic communication with a radiator such as a fan coil 14. A thermal transfer fluid such as the system refrigerant SR of the present invention is flowed through an interconnected network of conduits 16, 18, 20, 22, 24, 25, 26, 28, and through a heat exchanger 30, as will be more filly described below.

Specifically, during a heating cycle, system refrigerant SR is directed in a closed loop system in vapor form through conduit 16 through compressor inlet 17 and into compressor 12 which could be a scroll compressor or the like. After compression, the resulting hot compressed gas flow is directed through compressor outlet 19 to conduit 18 and directed by reversible gas flow valve 32 toward and through conduit 24 and then into outer jacket 25 of heat exchanger 30. The cooled hot gases are then directed through conduit 26 and flowed into fan coil inlet 34, through the fan coil 14 via fan coil conduits 36 for further heat exchange. The flow is then outputted through fan coil outlet 38 to conduit 20 in the closed loop system. During the heating cycle, a restrictor 40 having a predetermined Joule-Thompson coefficient further allows the liquid flow to expand as it enters conduit 20, which flow cools refrigerant SR in the outer jacket 25 of heat exchanger 30. Also, check valve 42 is closed during the heating cycle, and all liquidus fluid flow is directed into conduit 28. Check valve 42 may be a spring-checked directional check valve or the like as will be apparent to one skilled in the relevant art.

Heat exchanger 30 has a shell and tube construction, or other construction as will be apparent to the skilled artisan. For example, the heat exchanger 30 may have a double pipe or double-tube construction, an open vertical shell and tube construction, a horizontal shell and tube construction as shown herein, or a shell and coil construction.

Figure 2:
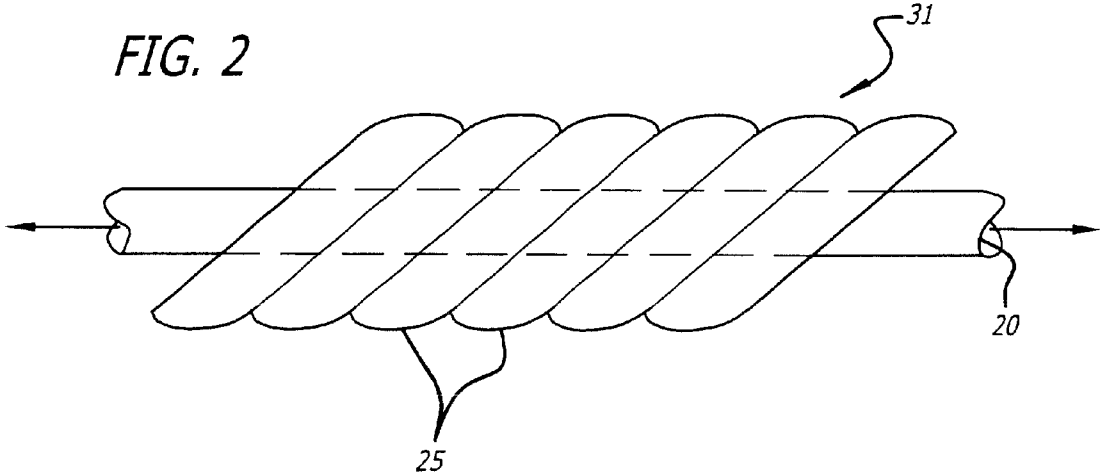
FIG. 2 is a front view of one embodiment of the heat exchanger of the present invention, showing a coaxial arrangement of thermally contacting refrigerant flow conduits.

For a double-tube condenser, coolant initially flows through an interior tube, which may be about 0.75–0.87 inch diameter copper or steel construction, although heat conductive tubing having a lesser or greater diameter may be used. An exterior tube also of heat conductive metal such as copper or steel construction surrounds the interior tube in generally concentric arrangement for refrigerant flow in the annular space defined between the tubes. The double-tube condenser may be formed into a coil to achieve a compact package for installation and servicing convenience. The exterior tube may be fabricated of about 1.0 to 1.25 inch diameter metal, although heat conductive tubing having a lesser or greater diameter may be used to accommodate refrigerant flow rates and heat transfer requirements. According to any construction, and according to the invention, outer conduit 25 is coiled about an axial extent of conduit 20 as necessary to effect the desired heat transfer quantity for a selected range of fluid flow rates through the system 10, or may be provided in closed shell form with an internal baffle arrangement (not shown). With reference to FIG. 2, heat exchanger 31 has a serpentine construction, with conduit 25 circumferentially extending about an axial length of conduit 20. A refrigerant such as Dupont brand Freon, R22, R134A or other refrigerant is selected to meet heat capacity, compressibility and volatility characteristics required for a specific application.

Again referring to FIG. 1, system 10 is selectively operable between heating and cooling applications. In the cooling mode, fluid refrigerant SR is flowed in a reverse cycle. Specifically, superheated vapor flow exiting from conduit 25 encompassing conduit 20 is directed toward valve 32, which shunts that flow toward conduit 16 and into compressor 12, to be returned via conduit 20 through heat exchanger 30 in the direction of arrow B. The resulting cooled fluid flow is flowed through open directional valve 42 and then toward restrictor 40, which allows the liquid to vaporize as it passes through conduit 26 and then through conduit 25 and then enters conduit 26 leading back to the compressor 12.

Accordingly, the refrigerant passing through conduit 20 in the direction of arrow B in a superheated, gaseous stage is condensed to a primarily liquid stage, and recycled through the system 10 in the mode required. It will be understood that the gaseous refrigerant flow may not be entirely condensed to a pure liquidus state, and such mixed liquidus-gaseous state does not hamper the operation of inventive system.

Figure 3:
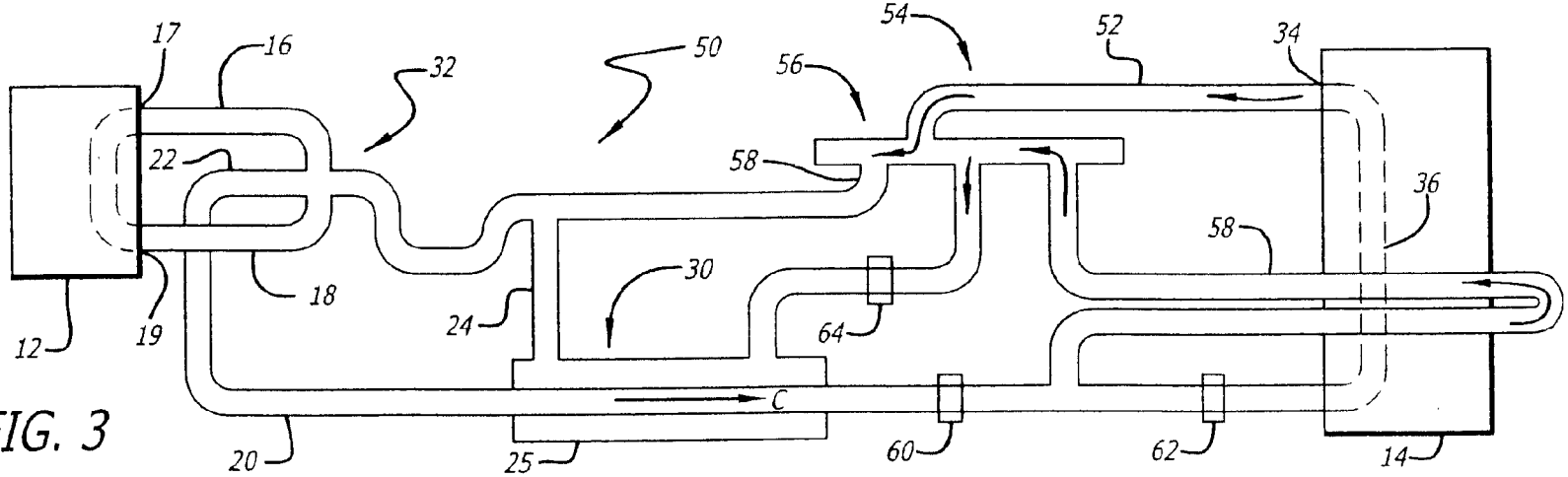
FIG. 3 is a block diagram representation of a second embodiment of the HVAC system of the present invention, showing a dual circuit reversing valve system switchable between heating and air-conditioning functions.

With reference now to FIG. 3, a second embodiment of the invention is shown with a dual return loop for enhancing heat exchange capacity of the inventive system. Accordingly, FIG. 3 includes all so-numbered elements of the first described embodiment, additionally showing elements of dual circuit reversing valve system. Specifically, system 50 further includes a return conduit 52 introducing a return vapor flow into reversing valve 54 to be directed toward and through conduit 56 in fluid connection with return conduit 58 which converges with outflow directed through conduit 24, the aggregate fluid flow then directed toward valve 32 in the manner previously described with respect to the embodiment shown and described in FIGS. 1 and 2. An intermediate coil extends through fan coil 14 for air-to-air heat transfer to further increase thermal efficiency of the operating system. During cooling operation of system 50, system refrigerant SR is flowed in the direction of arrow C through a directionally oriented restrictor 62, and then into coil 58 in the manner previously described. Another directionally oriented restrictor 60 is mounted for fluid flow in the reverse direction for operation of system 50 in the heating mode. A further directionally oriented restrictor 64 is mounted downstream of conduit 58 for operation in the cooling mode. Accordingly, whether during operation in heating mode or cooling mode, the present invention ensures a change of state necessary to cool hot gas flow to a substantially saturated liquid flow, as required for the required change of state in the heat exchanger.

Figure 4:
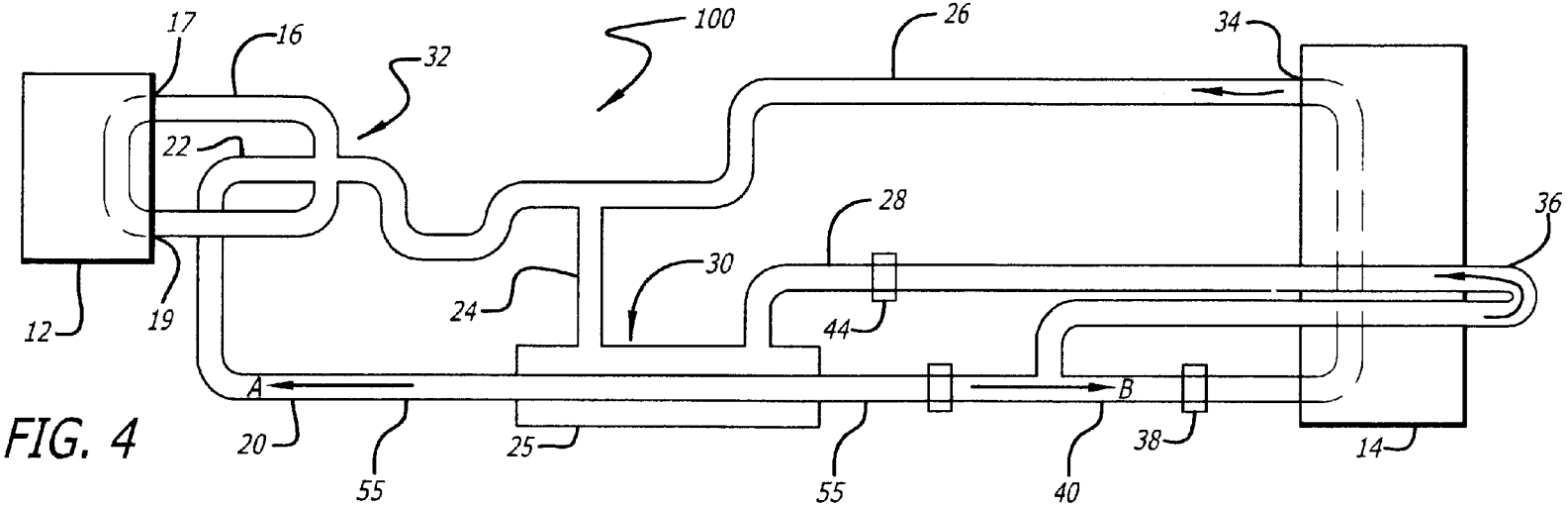
FIG. 4 is a block diagram representation of a third embodiment of the HVAC system of the present invention.

With reference now to FIG. 4, a third embodiment of the invention is shown for enhancing heat exchange capacity of the inventive system. Accordingly, FIG. 4 includes all so-numbered elements of the first and second described embodiments, additionally showing an alternative arrangement including directional restrictors for diverting and directing system refrigerant SR between the compressor 12 and fan coil 14 via the double-tube heat exchanger 30. Specifically, FIG. 4 shows the cool mode, and that drawing figure also shows the heating mode of this alternative arrangement, to achieve the operational goals set forth above.

Figure 5:
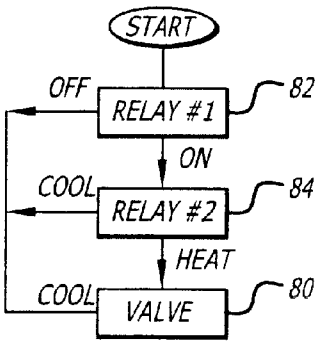
FIG. 5 is a schematic representation of the control system of the present invention.

With reference now to FIG. 5, control circuitry is utilized for control and operation of the present invention, whether for the single circuit or the dual circuit of the various embodiments of the invention. This control circuitry includes input and process controllers, as will be apparent to the skilled artisan. Specifically, input/output/process/conditional steps shown in FIG. 4 reference the inputs and controls for operation in heating and cooling modes. More specifically, a bi-directional valve 80 is controlled by a first relay 82 and a second relay 84. In order for the bi-directional valve 80 to operate in the heating mode, after first relay 82 turns off, second relay 84 is switched over to the heating mode and first relay 82, successively, turns on. In order that bidirectional valve 80 operates in the cooling mode, after first relay 82 turns off, second relay 84 is switched over to the cooling mode and first relay 82 returns to the turn-on state.

Prior to operation of the bi-directional valve 80, a control section 86 checks whether or not the system is in heating mode or cooling mode. When receiving a cooling mode selection signal, the control section 86 provides an electric power control section 88 with a first control signal. Depending on the first control signal, the control section 86 provides a second control signal which is a mode terminal switching signal and controls the system to switch between the heating mode and the cooling mode. The necessary control signals and feedback system provides consistent transition between modes and between a selected mode and a system shut-down mode.

As the skilled artisan will appreciate, the inventive system according to any of the disclosed embodiments may be operated with a millivolt control system, 24 volt control system, or other system as will be apparent to the skilled artisan.

It is to be understood that the present invention is not limited to the embodiments described above, but encompasses any and all embodiments within the scope of the following claims.

What I claim is:

1. A heat exchange system, comprising:

a heat exchanger;

a radiator in fluidic communication with the heat exchanger;

a compressor in fluidic communication with he heat exchanger;

apparatus for selectively operating the system in heating and air-conditioning modes; and a system refrigerant for heat transfer between the radiator and the heat exchange, the heat exchanger including a first conduit having an inlet and an outlet trough which the system refrigerant is flowed, and a second conduit having an inlet and an outlet through which the system refrigerant is flowed, the first conduit arranged for heat transfer contact in coaxial alignment around a periphery of the second conduit;

wherein the refrigerant fluid is non-aqueous-based; and further comprising a multiple flow refrigerant flow path parallel to and thermally isolated from the refrigerant flow direction through the heat exchanger.

2. A heat exchange system according to claim 1, wherein the second conduit is of generally elongate configuration, and the first conduit extends in a coiled configuration about an axial extent of the first conduit.

3. A heat exchange system according to claim 1, wherein the system refrigerant is a supercooled refrigerant.

4. A heat exchange system according to claim 3, wherein the second refrigerant fluid is selected from the group including R-22 and R-134.

5. A heat exchange system according to claim 1, further comprising a closed-loop refrigerant flow path.

6. A heat exchange system according to claim 1, further comprising a selectively operable reversing valve positioned in the system refrigerant flow path between the heat exchanger and the fan coil.

7. A heat exchange system according to claim 6, further comprising at least one directional restrictor in fluid communication with the system refrigerant flow path to maintain adiabatic and isentropic system balance.

8. A heat exchange system according to claim 1, further comprising a selectively operable reversing valve positioned in the flow path between the heat exchanger and the compressor.

9. A heat exchange system according to claim 8, further comprising at least one directional restrictor in fluid communication with the refrigerant flow path to maintain adiabatic and isentropic system balance.

10. A method of operating an HVAC system for selective operation in heating and air conditioning modes, comprising:

providing a heat exchanger;

providing a radiator in fluidic communication with the heat exchanger;

providing a compressor in fluidic communication with the heat exchanger;

flowing a system refrigerant between the radiator and the heat exchanger;

flowing the system refrigerant between the compressor and the heat exchanger; and maintaining adiabatic and isentropic balance during system operation.

11. A heat exchange system, comprising:

a heat exchanger;

a radiator in fluidic communication with the heat exchanger, said radiator including redundant heat exchange flow paths for flowing a system refrigerant therethrough, including a direct flow path from the heat exchanger and a flow path directly from a compressor;

the compressor in fluidic communication with the heat exchanger;

apparatus for selectively operating the system in heating and cooling modes; and wherein the system refrigerant provides for heat transfer between the radiator and the heat exchanger, the heat exchanger including a first conduit having an inlet and an outlet through which the system refrigerant is flowed, and a second conduit having an inlet and an outlet through which the system refrigerant is flowed, the first conduit arranged for heat transfer contact in coaxial alignment around a periphery of the second conduit;

wherein the refrigerant fluid is non-aqueous-based.

12. A heat exchange system according to claim 11, wherein the second conduit is of generally elongate configuration, and the first conduit extends in a coiled configuration about an axial extent of the first conduit.

13. A heat exchange system according to claim 11, wherein the system refrigerant is a super-cooled refrigerant.

14. A heat exchange system according to claim 13, wherein the system refrigerant fluid is selected from the group of refrigerants including R22 and R134A.

15. A heat exchange system according to claim 11, wherein the heat exchanger is selectively operated by a feedback control.

16. A heat exchange system according to claim 15, wherein the feedback control system is thermostatically controlled.

* * * * *